US005788472A

United States Patent [19]

Lee

[11] Patent Number: 5,788,472

[45] Date of Patent: Aug. 4, 1998

[54] HERMETIC ROTARY COMPRESSOR WITH ECCENTRIC ROLLER

[75] Inventor: Joon-Hyun Lee, Seoul, Rep. of Korea

[73] Assignee: Samsung Electronics Co., Ltd., Suwon, Rep. of Korea

[21] Appl. No.: 580,927

[22] Filed: Dec. 29, 1995

[30] Foreign Application Priority Data

Dec. 31, 1994 [KR] Rep. of Korea ..... 94-39605

[51] Int. Cl.[6] ..... F04C 18/356

[52] U.S. Cl. ..... 418/63

[58] Field of Search ..... 418/57, 63

[56] References Cited

U.S. PATENT DOCUMENTS

| | | | |
|---|---|---|---|
| 724,224 | 3/1903 | Weichmann | 418/57 |
| 1,489,416 | 4/1924 | Anderson et al. | 418/57 |
| 1,692,639 | 11/1928 | Elsner | 418/63 |
| 1,789,842 | 1/1931 | Rolaff | 418/63 |
| 4,219,314 | 8/1980 | Haggerty | 418/63 |

FOREIGN PATENT DOCUMENTS

| | | | |
|---|---|---|---|
| 875388 | 5/1953 | Germany | 418/57 |
| 429791 | 6/1935 | United Kingdom | 418/57 |

*Primary Examiner*—John J. Vrablik

*Attorney, Agent, or Firm*—Burns, Doane, Swecker & Mathis, L.L.P.

[57] ABSTRACT

A rotary compressor includes a motor which rotates a crankshaft about an axis. The crankshaft includes an eccentric portion disposed in a cylinder which has a fluid inlet and a fluid outlet. A roller is mounted on the eccentric portion to be orbited within the cylinder when the crankshaft rotates, for compressing fluid. The eccentric portion and roller are together movable radially with respect to the axis in response to centrifugal force, so that the roller maintains tight contact with the cylinder.

4 Claims, 5 Drawing Sheets

HERMETIC ROTARY COMPRESSOR WITH ECCENTRIC ROLLER

BACKGROUND OF THE INVENTION

1. Field of the Invention

The present invention relates in general to hermetic (sealed) rotary compressors and, more particularly, to a structural improvement in such compressors for preventing the formation of a gap at contact junction between the roller and the refrigerant compressing cylinder of the compressor.

2. Description of the Prior Art

Japanese Patent Laid-open Publication No. Sho. 62-191691 discloses a lubricating structure for hermetic rotary compressors. The above Japanese lubricating structure is shown in the accompanying drawing, FIG. 1. As shown in the drawing, the typical lubricating structure for hermetic rotary compressors includes a motor unit 2 which is provided in the upper section inside a hermetic casing 1 of a compressor. Contained in the lower section of the hermetic casing 1 is cooling and lubricating oil 4. The above motor unit 2 includes a motor 5 having a shaft 6 with an eccentric end portion 6A. A roller 7, which is fitted over the eccentric portion 6A of the above motor shaft 6, is received in a compressing cylinder 8. The above shaft 6 is held by upper and lower bearings 9 and 10. The shaft 6 is also hollowed to define a through hole 11 which tightly receives both a torsional plate 12 and a lubricating member 13. The side wall of the hollow shaft 6 is radially perforated to form three radial holes 14, 15 and 16 which communicate with wobble surfaces of the upper bearing 9, roller 7 and lower bearing 10 respectively. The upper and lower bearings 9 and 10 are provided with oil grooves (not shown) for lubricating the gaps between the shaft 6 and bearings 9 and 10. The lower end portion of the hollow shaft 6 with the lubricating member 13 is sunk in the oil 4. Therefore, the oil 4 is sucked into the through hole 11 of the shaft 6 by way of the lubricating member 13 to flow up in the hole 11 when the shaft 6 rotates by the rotating force of the motor 5. The oil 4 sucked into the hollow shaft 6 in turn is supplied to the wobble surfaces of the upper bearing 9, roller 7 and lower bearing 10 through the radial holes 14, 15 and 16, respectively.

In the above structure, lubrication for the wobble surfaces of the upper bearing 9, roller 7 and lower bearing 10 is achieved by both the centrifugal force caused by the rotating motion of the shaft 6 and the viscosity of the oil 4 which is sucked into the hollow shaft 6 according to the rotating motion of the shaft 6. However, when the above lubricating structure is used with a typical low speed compressor, it may fail to exhibit its expected operational effect as the low speed compressor has a lower rotating speed of about ⅓ to ¼ of the constant rotating speed of a conventional constant speed compressor. The above lubricating structure in the above case thus produces poor lubrication on the frictional contact portions of the low speed compressor, thereby causing an abnormal frictional abrasion and knocking of the compressor.

Furthermore, it is impossible to adjust the gap between the roller 7 and cylinder 8 in the typical hermetic rotary compressors. Therefore, a typical hermetic rotary compressor exhibits leakage of the refrigerant while compressing the refrigerant introduced into the cylinder. The typical hermetic rotary compressor thus compresses additional refrigerant in the amount of leaking refrigerant in order to compensate for the leaking refrigerant. In this regard, the above compressor may either overload or excessively compress the refrigerant, thereby reducing operational efficiency and reliability.

SUMMARY OF THE INVENTION

It is, therefore, an object of the present invention to provide a structurally improved hermetic rotary compressor in which the above problems can be overcome and which prevents leakage of the refrigerant and thereby improves operational efficiency and reliability.

In order to accomplish the above object, the present invention provides a hermetic rotary compressor having upper and lower bearings and a refrigerant compressing cylinder, further including an eccentric shaft eccentrically mounted to one end portion of a crank shaft, and a roller placed in the cylinder and rotatably and slidably fitted over the eccentric shaft for radial sliding movement relative to the axis of the crankshaft, in response to centrifugal force.

BRIEF DESCRIPTION OF THE DRAWINGS

For a better understanding of the nature and objects of the invention, reference is made to the following detailed description in connection with the accompanying drawings, in which.

DESCRIPTION OF A PREFERRED EMBODIMENT

Figure 1:
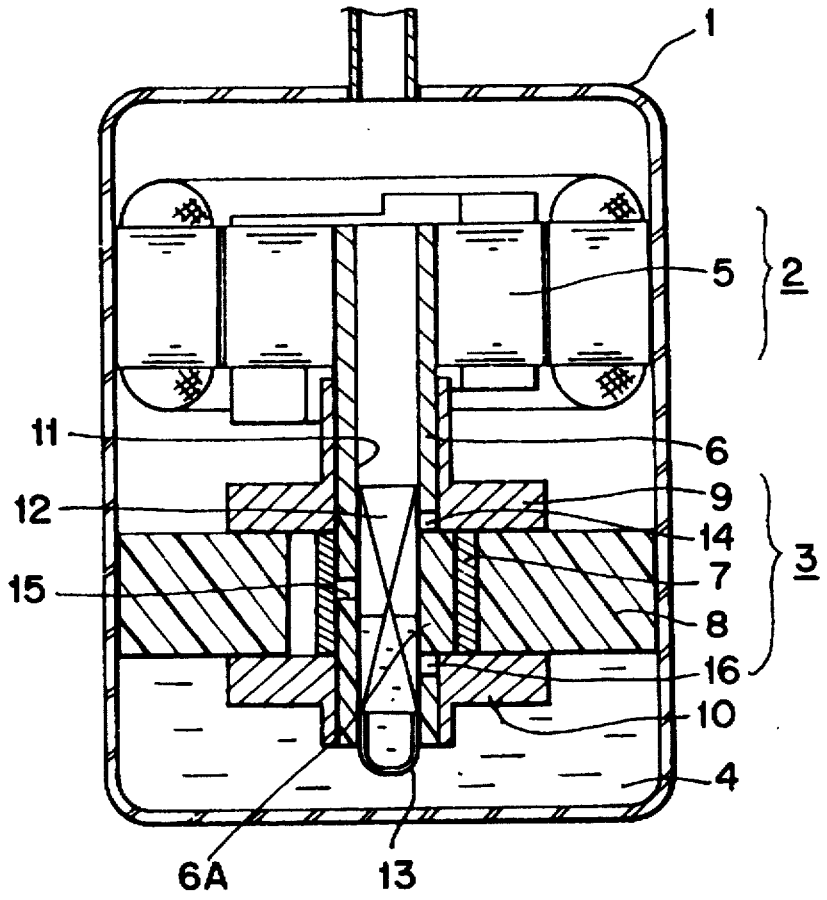
FIG. 1 (PRIOR ART)
FIG. 1 is a sectional view of a conventional hermetic rotary compressor, showing a typical lubricating structure of the compressor.
Figure 2:
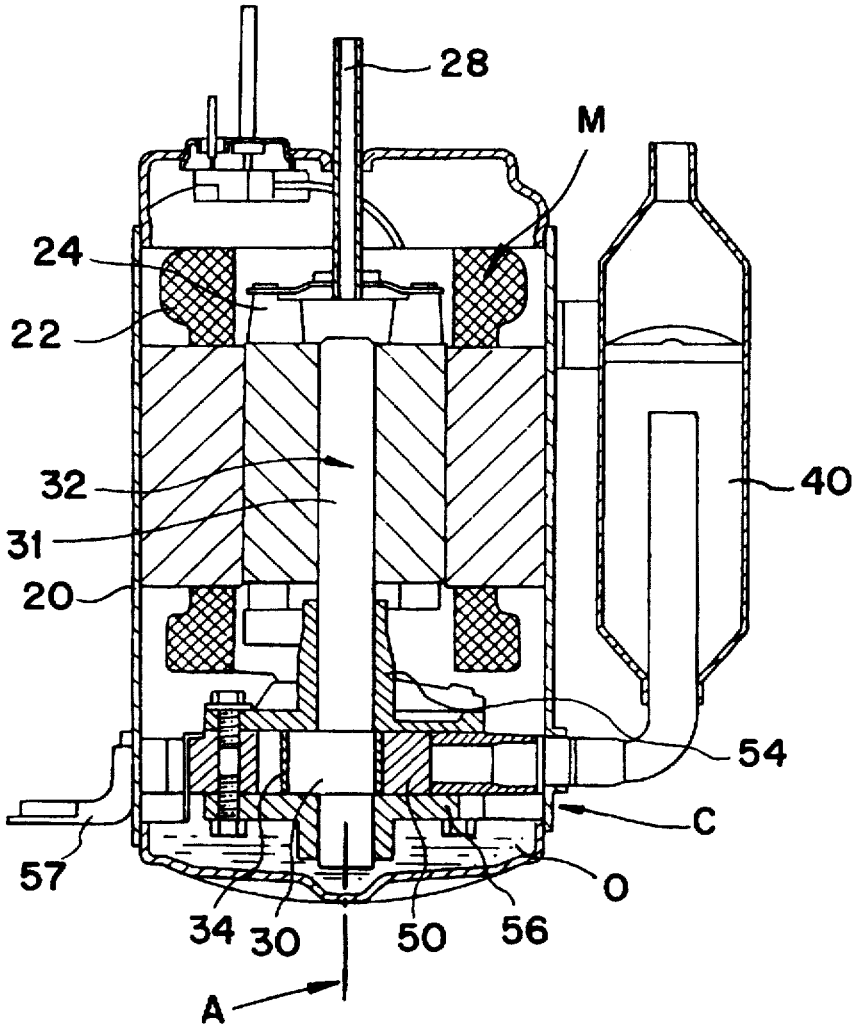
FIG. 2 is a sectional view showing the construction of a hermetic rotary compressor in accordance with a preferred embodiment of the present invention.

FIG. 2 is a sectional view showing the construction of a hermetic rotary compressor in accordance with a preferred embodiment of the present invention. As shown in the drawing, the hermetic rotary compressor of the present invention includes a motor unit [M] and a compression unit [C] which are fitted over a crank shaft 32 in a hermetic casing 20. Contained in the lower section of the hermetic casing 20 is cooling and lubricating oil [O]. The above motor unit M includes a stator 22 and a rotor 24. The stator 22 of the unit M, which is fixed to the internal wall of the casing 20, is applied with external electric power to form a magnetic field, while the rotor 24 is fixedly fitted over a main portion 31 of the crank shaft 32 and rotates by the magnetic field of the stator 22, thereby generating rotating force to rotate the crankshaft about an axis A.

The compression unit C includes a pair of bearings, that is, upper and lower bearings 54 and 56. The above bearings 54 and 56 are fixed to the internal wall of the casing 20 and cover both ends of a refrigerant compressing cylinder 50. The bearings 54 and 56 are also tightly fitted over the crank shaft 32 to hold the shaft 32. The top and bottom ends of the cylinder 50 are covered by the upper and lower bearings 54 and 56, respectively. Mounted to the lower end portion of the crank shaft 32 is an eccentric shaft 30. A roller 34, which is placed in the cylinder 50, is rotatably and slidably fitted over the eccentric shaft 30.

A refrigerant outlet pipe 28, which discharges the refrigerant compressed in the cylinder 50, extends from the top section of the casing 20. The above compressor also includes a refrigerant inlet pipe 57 which is connected to one side of the casing 20 to guide the refrigerant to the cylinder 50. Mounted to the casing 20 at the other side of the casing 20 is an accumulator 40.

Figure 3:
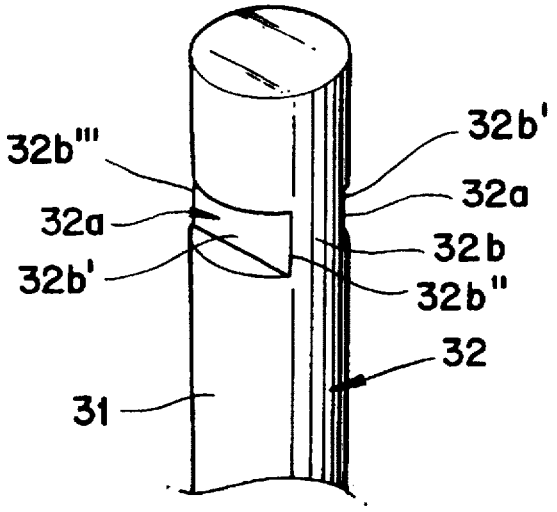
FIG. 3 is a perspective view of a crank shaft of the compressor of FIG. 2.

One end portion of the above cylindrical crank shaft 32 is laterally cut with grooves **32*a* to form a neck 32*b* of reduced cross section as shown in FIG. 3. The grooves 32*a* include respective planar surfaces 32*b*' disposed on opposite sides of the axis and oriented parallel to one another and to the axis. Each of the surfaces intersects a circumferential outer periphery of the shaft 32 at two circumferentially spaced locations 32*b*" and 32*b*'"**.

Figure 4:
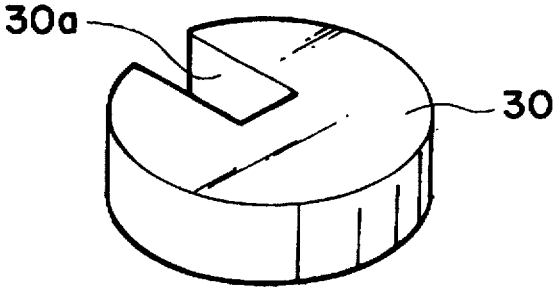
FIG. 4 is a perspective view of an eccentric shaft of the compressor of FIG. 2.
Figure 6:
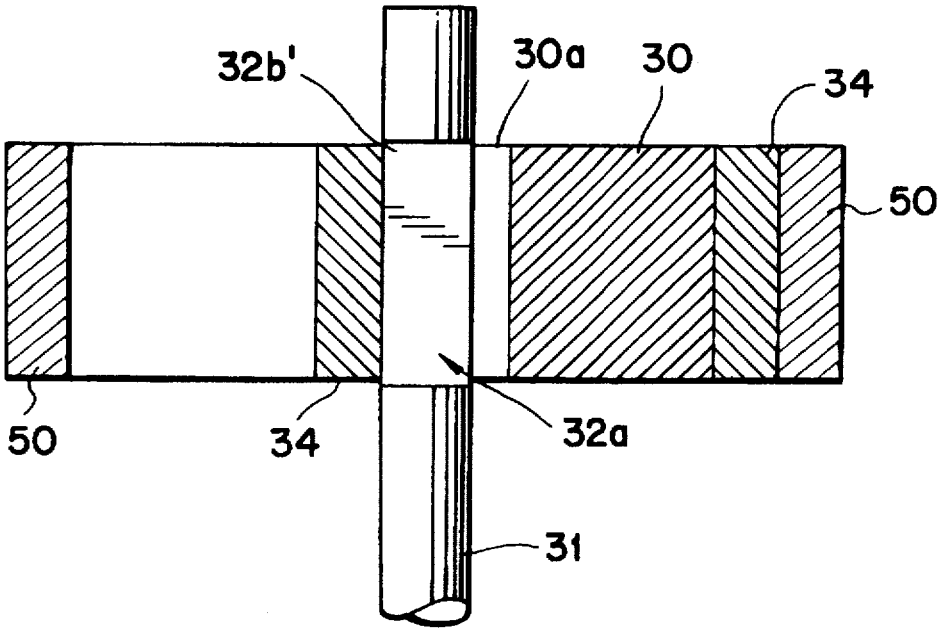
FIG. 6 is a sectional view taken along the section line 6—6 of FIG. 5.

As shown in FIGS. 4 and 6, the eccentric shaft 30 is partially radially cut to form a radial notch **30*a* which slidably engages with the neck 32*b* of the crank shaft 32, thereby eccentrically and slidably mounting the eccentric shaft 30 to the crank shaft 32. Therefore, the eccentric shaft 30 eccentrically rotates with the crank shaft 32 while sliding radially outward relative to the axis A on the neck 32*b* of the crank shaft 32 when the crank shaft 32 rotates by the rotating force of the motor unit M. The roller 34 is concentrically fitted over the eccentric shaft 30 so that the roller 34 is eccentric relative to the crank shaft 32. During the rotating motion of the crank shaft 32, a centrifugal force is generated between the crank shaft 32 and roller 34. The roller 34 in the above state orbits within the cylinder and is brought into tight contact with the internal surface of the cylinder 50, because it can slide radially relative to the crankshaft 32 in response to centrifugal force. In this state there is no gap in the contact junction between the roller 34 and cylinder 50**.

Figure 5:
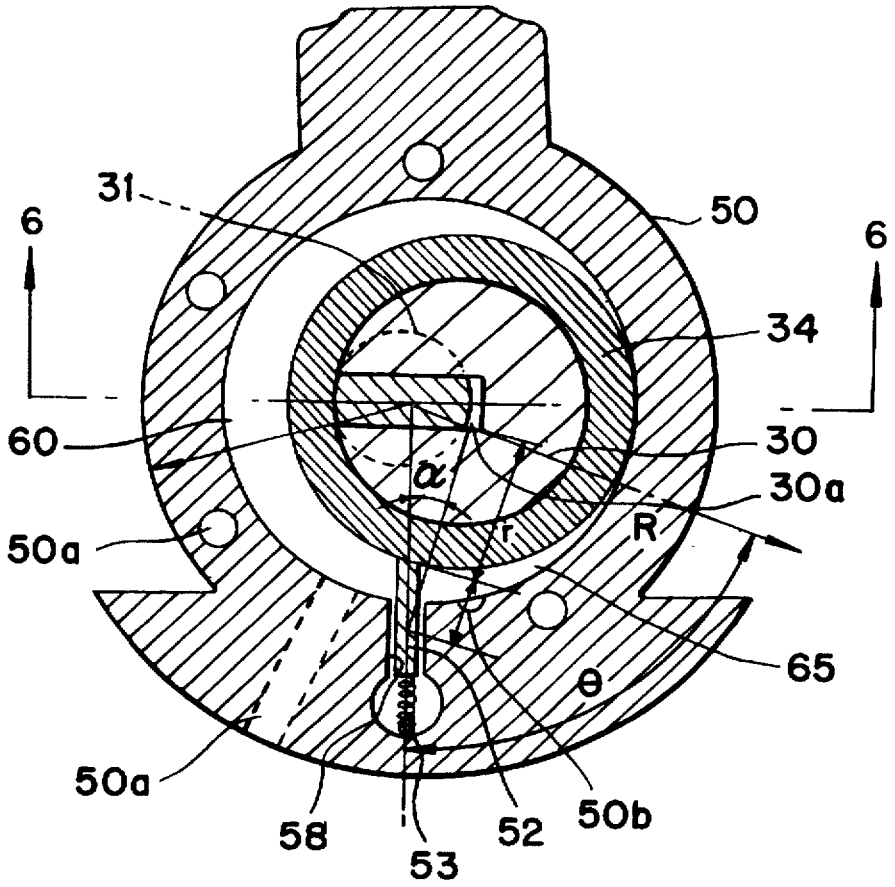
FIG. 5 is a cross-sectioned view showing the assembled structure of the crank shaft and eccentric shaft set in a refrigerant compressing cylinder of the compressor according to the present invention.

FIG. 5 is a cross-sectioned view of the compressor of FIG. 2. As shown in the drawing, the internal surface of the cylinder 50 is provided with a vane slot 58 which movably receives a spring-biased vane 52. The spring-biased vane 52 divides the internal space of the cylinder 50 into two chambers, that is, suction and compression chambers 60 and 65. The bottom end of the vane 52 is biased by a compression coil spring 53 disposed in the vane slot 58, so that the top end of the vane 52 always comes into contact with the outer surface of the roller 34.

The operation of the above hermetic rotary compressor will be described below.

When electric power is applied to the stator 22 of the motor unit M, the stator 22 forms a magnetic field which causes the rotor 24 to rotate.

As the rotor 24 is fixed to the crank shaft 32, the rotating force of the rotor 24 is transmitted to the shaft 32 thereby rotating the shaft 32 at a high speed. When the crank shaft 32 rotates at a high speed, the eccentric shaft 30 eccentrically rotates in the cylinder 50 as the shaft 30 is eccentrically and slidably mounted to the neck **32*b* of the crank shaft 32. The roller 34, which is rotatably and slidably fitted over the eccentric shaft 30, thus eccentrically rotates in the cylinder 50. When the roller 34 eccentrically rotates in the cylinder 50 as described above, the spring-biased vane 52 linearly reciprocates as the vane 52 is movably received in the vane slot 58 of the cylinder 50 and always comes into contact with the roller 34**.

As described above, the eccentric shaft 30 whose sliding notch **30*a* movably engages with the neck 32*b* of the crank shaft 32 slides on the neck 32*b* while being guided by that neck when the crank shaft 32 rotates. Therefore, a centrifugal force is generated between the rotating crank shaft 32 and the rotating and revolving roller 34. Due to the above centrifugal force, the eccentric shaft 30 which is fitted in the roller 34 slides on the neck 32*b* of the crank shaft 32** in the direction of the centrifugal force.

The refrigerant, which has been evaporated by an evaporator (not shown), is introduced into the suction chamber 60 of the cylinder 50 through a refrigerant inlet port **50*a* of the cylinder 50. The refrigerant in the cylinder 50 is compressed by the eccentric rotating and sliding motion of the roller 34 in the cylinder 50**.

The roller 34 generates a contact force when it comes into contact with the internal surface of the cylinder 50 during its eccentric rotating and sliding motion in the cylinder 50. Therefore, there is no gap in the contact junction between the roller 34 and cylinder 50. After compressing the refrigerant into a high temperature and pressure refrigerant, the roller 34 opens the refrigerant outlet port **50*b* to discharge the compressed refrigerant from the cylinder 50. After discharging the compressed refrigerant, the roller 34 closes the outlet port 50*b* due to the gaseous refrigerant suction force of the cylinder 50. Thereafter, the inlet port 50*a* of the cylinder 50 is opened to introduce gaseous refrigerant into the suction chamber 60 of the cylinder 50** prior to compressing the refrigerant. During the refrigerant compressing operation, the above compressor repeats the above-mentioned process.

During the refrigerant compressing operation, the moving distance of the roller 34 is equal to the eccentricity of the crank shaft 32 which is designed to form the stroke volume of the cylinder 50. The contact force generated when the roller 34 comes into centrifugal contact with the internal surface of the cylinder 50 is represented by the following kinetic equation.

$$Fc-Fgr=Fs$$

wherein

Fc is the centrifugal force generated by the roller and eccentric shaft,

Fgr is the radial compressing force of the gaseous refrigerant generated when compressing the refrigerant, and Fs is the contact force generated when the roller comes into centrifugal contact with the internal surface of the cylinder.

In addition, the above centrifugal force Fc is represented by the following equation.

$$Fc=(Mr+Mc)\ rw^2$$

wherein

Mr is roller's mass,

Mc is eccentric shaft's mass, r is the eccentricity, and w is the angular speed of rotation.

The above compressing force Fgr of the gaseous refrigerant is represented by the following equation.

$$Fgr=[2r\ \sin(\theta+\alpha)]/2\cdot[l(Pc-Ps)\ \sin\ (\theta+\alpha)]/2$$

wherein l is the height of the cylinder,

Pc is the pressure of the compression chamber of the cylinder,

Ps is the pressure of the suction chamber of the cylinder, $\theta$ is the rotative angle of the crank shaft, and $\alpha$ is the angle shown in FIG. 5.

As described above, the present invention provides a structurally improved hermetic rotary compressor. In the above compressor, the eccentric shaft is provided with a sliding notch which slidably engages with a neck portion of the crank shaft. The eccentric shaft thus eccentrically rotates while sliding outward on the neck portion when the crank shaft is rotated by the rotating force of the motor unit. A roller is fitted over the eccentric shaft. Therefore, when the crank shaft rotates, a centrifugal force is generated between the crank shaft and roller, thereby causing the roller to come into close contact with the internal surface of the cylinder while eccentrically rotating in the cylinder along with the eccentric shaft. Therefore, there is no gap in the contact junction between the roller and cylinder thereby preventing the compressor from excessively compressing the refrigerant. In this regard, the present invention improves the compression efficiency and operational reliability of the hermetic rotary compressor.

Having described a specific preferred embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. A hermetic rotary compressor, comprising:

a housing;

a motor in said housing;

a stationary cylinder in said housing and having a fluid inlet and a fluid outlet;

a crankshaft rotated about an axis by said motor and including an eccentric portion disposed in said cylinder; and a roller mounted on said eccentric portion to be orbited thereby within said cylinder for compressing fluid received through said inlet, said roller being slidable radially relative to said axis in response solely to centrifugal force to maintain tight radial contact with said cylinder;

said crankshaft comprising a main portion rotatable about said axis, said eccentric portion being mounted on said main portion and slidable radially relative thereto along with said roller in response to centrifugal force.

2. The compressor according to claim 1 wherein said main portion includes a neck of reduced cross section, said eccentric portion being mounted for radial sliding movement on said neck.

3. The compressor according to claim 2 wherein said eccentric portion includes a radial notch in which said neck is disposed.

4. The compressor according to claim 3, wherein the neck is defined by a pair of grooves formed in the shaft, the grooves including respective planar surfaces disposed on opposite sides of the axis and oriented parallel to one another and to the axis, each of the surfaces intersecting a circumferential outer periphery of the shaft at two circumferentially spaced apart locations.

* * * * *